US006377219B2

(12) United States Patent
Smith

(10) Patent No.: US 6,377,219 B2
(45) Date of Patent: Apr. 23, 2002

(54) COMPOSITE MOLDED ANTENNA ASSEMBLY

(75) Inventor: Lyle James Smith, Providence, RI (US)

(73) Assignee: Cool Options, Inc., Warwick, RI (US)

( * ) Notice: Subject to any disclaimer, the term of this patent is extended or adjusted under 35 U.S.C. 154(b) by 0 days.

(21) Appl. No.: 09/757,720

(22) Filed: Jan. 10, 2001

Related U.S. Application Data

(60) Provisional application No. 60/175,496, filed on Jan. 11, 2000.

(51) Int. Cl.[7] ..... H01Q 1/24

(52) U.S. Cl. ..... 343/702; 62/331; 165/182; 361/705; 174/16.3

(58) Field of Search ..... 343/702; 62/331, 62/480, 497; 165/166, 170, 182; 361/704, 705; 174/16.3, 52.4; 257/702, 704

(56) References Cited

U.S. PATENT DOCUMENTS

| | | | | | |
|---|---|---|---|---|---|
| 3,790,859 | A | | 2/1974 | Schraeder et al. | 317/100 |
| 4,739,449 | A | | 4/1988 | Kaufman | 361/388 |
| 4,831,495 | A | | 5/1989 | Harding | 361/386 |
| 4,925,295 | A | * | 5/1990 | Ogawa et al. | 353/57 |
| 5,099,550 | A | | 3/1992 | Beane et al. | 24/555 |
| 5,155,579 | A | | 10/1992 | AuYeung | 357/81 |
| 5,175,668 | A | | 12/1992 | Kendel | 361/386 |
| 5,194,935 | A | | 3/1993 | Kitano et al. | 357/706 |
| 5,296,740 | A | | 3/1994 | Sono et al. | 257/706 |
| 5,315,480 | A | | 5/1994 | Samarov et al. | 361/705 |
| 5,348,686 | A | * | 9/1994 | Vyas | 252/514 |
| 5,379,186 | A | | 1/1995 | Gold et al. | 361/706 |
| 5,379,187 | A | | 1/1995 | Lee et al. | 361/707 |
| 5,461,201 | A | | 10/1995 | Schonberger et al. | 174/16.3 |
| 5,672,414 | A | | 9/1997 | Okamoto et al. | 428/209 |
| 5,781,412 | A | | 7/1998 | de Sorgo | 361/704 |
| 5,802,709 | A | | 9/1998 | Hogge et al. | 29/827 |
| 5,812,374 | A | | 9/1998 | Shuff | 361/704 |
| 5,825,608 | A | | 10/1998 | Duva et al. | 361/302 |
| 5,873,258 | A | * | 2/1999 | Pfister et al. | 62/331 |
| 5,901,041 | A | | 5/1999 | Davies et al. | 361/704 |
| 5,930,117 | A | | 7/1999 | Gengel | 361/720 |
| 5,986,885 | A | | 11/1999 | Wyland | 361/704 |
| 6,059,017 | A | * | 5/2000 | Sayegh | 165/41 |
| 6,084,772 | A | * | 7/2000 | Pell et al. | 361/699 |

FOREIGN PATENT DOCUMENTS

| | | | | |
|---|---|---|---|---|
| JP | 62-81735 | | 4/1987 | |
| JP | 01193597 | * | 8/1989 | 165/182 |

* cited by examiner

*Primary Examiner*—Tho G. Phan
(74) *Attorney, Agent, or Firm*—Barlow, Josephs & Holmes, Ltd.

(57) ABSTRACT

A net-shape molded composite heat exchanger is provided which includes a plurality of thermally conductive fins overmolded onto one end of a metallic heat pipe for use both as an antenna in a cellular telephone and a heat exchanger to dissipate the heat generated within the device. The heat exchanger is formed by net-shape molding the fins over one end of the heat pipe, from a thermally conductive composition, such as a polymer composition. The molded heat exchanger is freely convecting through the part, which makes it more efficient and has an optimal thermal configuration. In addition, the metallic heat pipe serves the additional function of conducting radio frequency waves to and from the cellular telephone device.

7 Claims, 3 Drawing Sheets

12
10
14
24
12
18
50
20
22

COMPOSITE MOLDED ANTENNA ASSEMBLY

This application claims benefit of U.S. provisional application Ser. No. 60/175,496, filed Jan. 11, 2000.

BACKGROUND OF THE INVENTION

The present invention relates generally to the cooling of heat generating surfaces and objects. More specifically, the present invention relates to apparatuses for dissipating heat generated by such objects. In addition, the present invention relates to the use of composite materials in electronic devices to dissipating heat away from heat generating components within the devices and to avoid component failure and failure of the overall device.

In industry, there are various parts and components that generate heat during operation. For example, in the portable electronics industry, it is well known that cellular phones include electronic components that run very hot thus causing a severe overheating problem within the cellular phone itself. Various types of electronic device packages and integrated circuit chips, such as the central processing chip and signal generator chips used in cellular telephones are such devices that generate heat. These integrated circuit devices, particularly the central processing chips, generate a great deal of heat during operation, which must be removed to prevent adverse effects on operation of the system into which the device is installed. For example, a cellular telephone processor chip, which is generally installed into a very compact and densely constructed device, is highly susceptible to overheating which could destroy the processor chip itself or other components proximal to the microprocessor.

There are a number of prior art methods to cool heat generating components and objects to avoid device failure and overheating, as discussed above. A block heat sink or heat spreader is commonly placed into communication with the heat-generating surface of the object to dissipate the heat therefrom. Such a heat sink typically includes a base member with a number of individual cooling members, such as fins, posts or pins, to assist in the dissipation of heat. The geometry of the cooling members is designed to improve the surface area of the heat sink with the ambient air for optimal heat dissipation. The use of such fins, posts of pins in an optimal geometrical configuration greatly enhances heat dissipation compared to devices with no such additional cooling members, such as a flat heat spreader. The drawback to the use of these types of heat dissipation devices is that they necessarily conduct the heat to the outside surface of the device being cooled. In this case the outer surfaces of a cellular telephone can get quite hot, an undesirable result for a hand held electronic device.

To further enhance airflow and resultant heat dissipation, fans and devices have been used, either internally or externally. However, these external devices consume power and have numerous moving parts. As a result, heat sink assemblies with active devices are subject to failure and are much less reliable than a device that is solely passive in nature. In addition, due to the compact nature of a cellular telephone and the limited battery life available to power the electronics, these active device solutions are simply ineffective.

It has been discovered that more efficient cooling of electronics can be obtained through the use of passive devices that require no external power source and contain no moving parts. The devices of the prior art are simply the technology previously used for CPUs and modified to connect to other processing packages. In particular, machined block heat sinks or heat spreader plates of metal have been typically used for cooling cellular processor chips, as described above. Since the prior art heat sink is made of metal, it must be machined to achieve the desired fin configuration. Since the machining process is limited, the geometry of the fin configuration of a machined heat sink is inherently limited.

In the heat sink industries, it has been well known to employ metallic materials for thermal conductivity applications, such as heat dissipation for cooling semiconductor device packages. For these applications, such as heat sinks, the metallic material typically is tooled or machined from bulk metals into the desired configuration. However, such metallic conductive articles are typically very heavy, costly to machine and are susceptible to corrosion. Further, the geometries of machined metallic heat dissipating articles are very limited to the inherent limitations associated with the machining or tooling process. As a result, the requirement of use of metallic materials which are machined into the desired form, place severe limitations on heat sink design particular when it is known that certain geometries, simply by virtue of their design, would realize better efficiency but are not attainable due to the limitations in machining metallic articles.

It is widely known in the prior art that improving the overall geometry of a heat-dissipating article can greatly enhance the overall performance of the article even if the material is the same. Therefore, the need for improved heat sink geometries necessitated an alternative to the machining of bulk metallic materials. To meet this need, attempts have been made in the prior art to provide molded compositions that include conductive filler material therein to provide the necessary thermal conductivity. The ability to mold a conductive composite enabled the design of more complex part geometries to realize improved performance of the part.

In addition, due to the compact size of portable electronics, processor components are typically designed to fit into tight and narrow spaces. However, these components now require heat dissipation for which there is very little or no space.

In view of the foregoing, there is a demand for a heat sink assembly that is capable of dissipating heat. There is a demand for a passive heat sink assembly with no moving parts that can provide heat dissipation without the use of active components. In addition, there is a demand for a complete heat sink assembly that can provide greatly enhanced heat dissipation over prior art passive devices with improved heat sink geometry. There is a demand for a heat sink assembly that can provide heat dissipation in a low profile configuration. There is a further demand for a net-shape molded heat sink assembly that is well suited for cooling processor components within portable electronic devices, such as cellular telephones.

SUMMARY OF THE INVENTION

The present invention preserves the advantages of prior art heat dissipation devices, heat exchangers and heat spreaders. In addition, it provides new advantages not found in currently available devices and overcomes many disadvantages of such currently available devices.

The invention is generally directed to the novel and unique composite molded heat exchanger that is net-shape molded of a thermally conductive polymer composition over a heat pipe. The present invention relates to a molded heat exchanger for dissipating heat from a heat-generating source, such as a processor semiconductor chip or electronic components in a portable electronic device, such as a cellular telephone.

The present invention provides for the use of a cellular phone antenna as a heat-dissipating member to remove heat from the cellular phone to avoid overheating. As shown in the attached drawing figures, the invention includes a heat pipe overmolded with a thermally conductive polymer composition. This thermally conductive polymer composition may be easily molded into any desired configuration to which permits the formation of complex geometries to improve the overall thermal dissipation performance of the antenna. The antenna, includes the heat pipe overmolded with a thermally conductive polymer composition, is thermally interconnected to the components of the cellular phone that run hot. As result of the present invention, heat dissipation of thermally conductive components within the cellular phone may be easily carried out to maintain the temperature of the body of the cellular phone itself within an acceptable range.

The molded heat exchanger of the present invention has many advantages over prior art heat sinks in that the heat dissipation element is injection molded from thermally conductive polymer materials which enables the part to be made in complex geometries. These complex geometries enable the heat sink fin configuration to be optimized to be more efficient thus dissipating more heat. As a result, the molded heat exchanger is freely convecting through the part, which makes it more efficient. The ability to injection mold the heat exchanger permits the optimal configuration to be realized and achieved. A heat pipe configuration is provided which extends to the various heat generating components within the device to conduct the heat from the interior of the device to the molded heat sink portion of the present invention. With the present molded he exchanger, the heat sink fins can be designed to what is thermally best while not being limited to the manufacturing and mechanical limitations with prior art processes, such as brazing.

In addition to providing a conduit by which to conduct heat from the various electronic components within the cellular telephone, the metallic construction of the outer casing of the heat pipe also makes it suited to act as an antenna for sending and receiving the RF signal required for the telephone's functionality. Thus, by placing the heat pipe and overmolded heat sink in the position of a cellular antenna, the heat is conducted to a location not normally contacted by the user during operation of the device, preventing the user from having to hold onto potentially hot surfaces.

It is therefore an object of the present invention to provide a heat-dissipating device that can provide enhanced heat dissipation for a heat generating component or object.

It is an object of the present invention to provide a heat-dissipating device that can provide heat dissipation for semiconductor devices in a portable electronic device, such as a cellular telephone.

It is a further object of the present invention to provide a heat-dissipating device that has no moving parts.

Another object of the present invention is to provide a heat-dissipating device that is completely passive and does not consume power.

A further object of the present invention is to provide a composite heat dissipation device that inexpensive to manufacture.

An object of the present invention is to provide a heat exchanger that is net-shape moldable and has pathway by which to convey heat to a convenient location for dissipation.

Yet another objection of the present invention is to provide a molded exchanger that has a low profile configuration without sacrificing thermal transfer efficiency.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
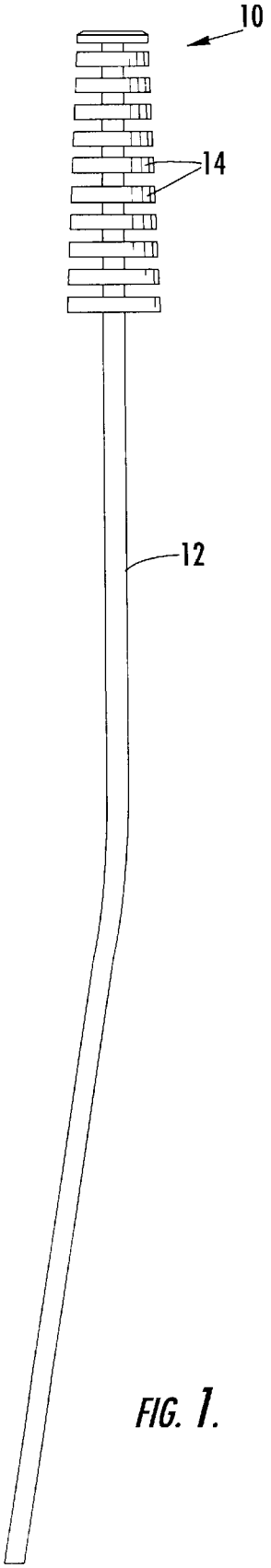
FIG. 1 is front view of the composite molded heat exchanger of the present invention.
Figure 2:
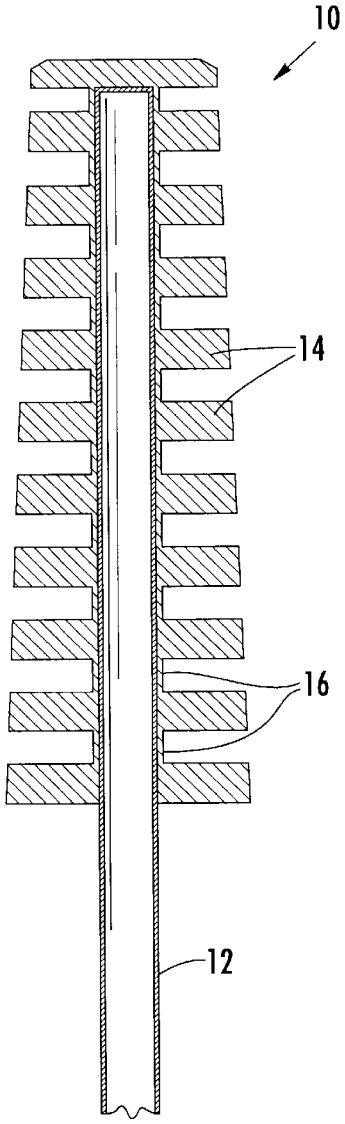
FIG. 2 is a general cross-sectional view through the composite molded heat exchanger in FIG. 1.
Figure 3:
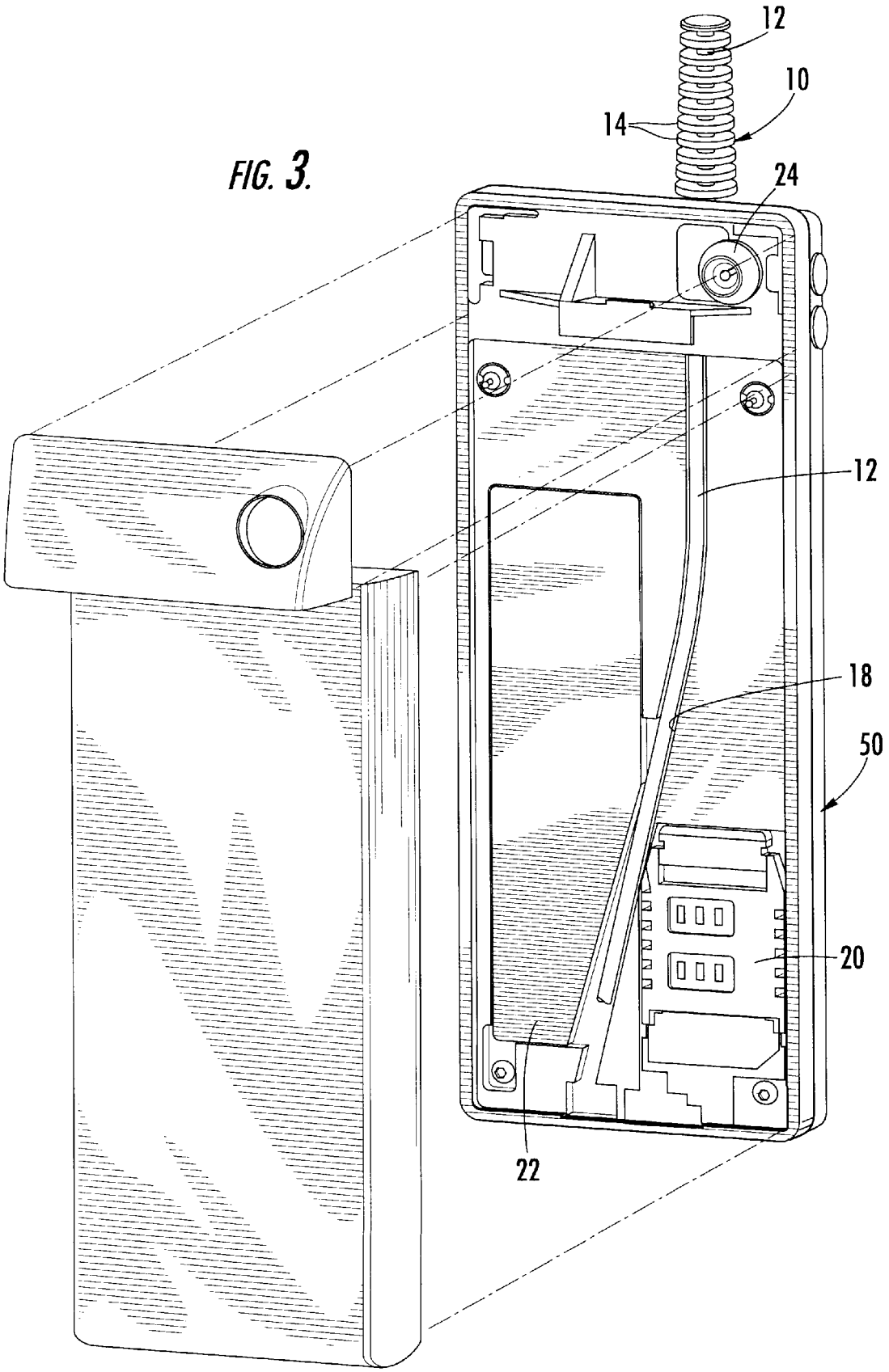
FIG. 3 is a perspective view of the preferred embodiment of the composite molded heat exchanger of the present invention installed in a cellular telephone.
Figure 4:
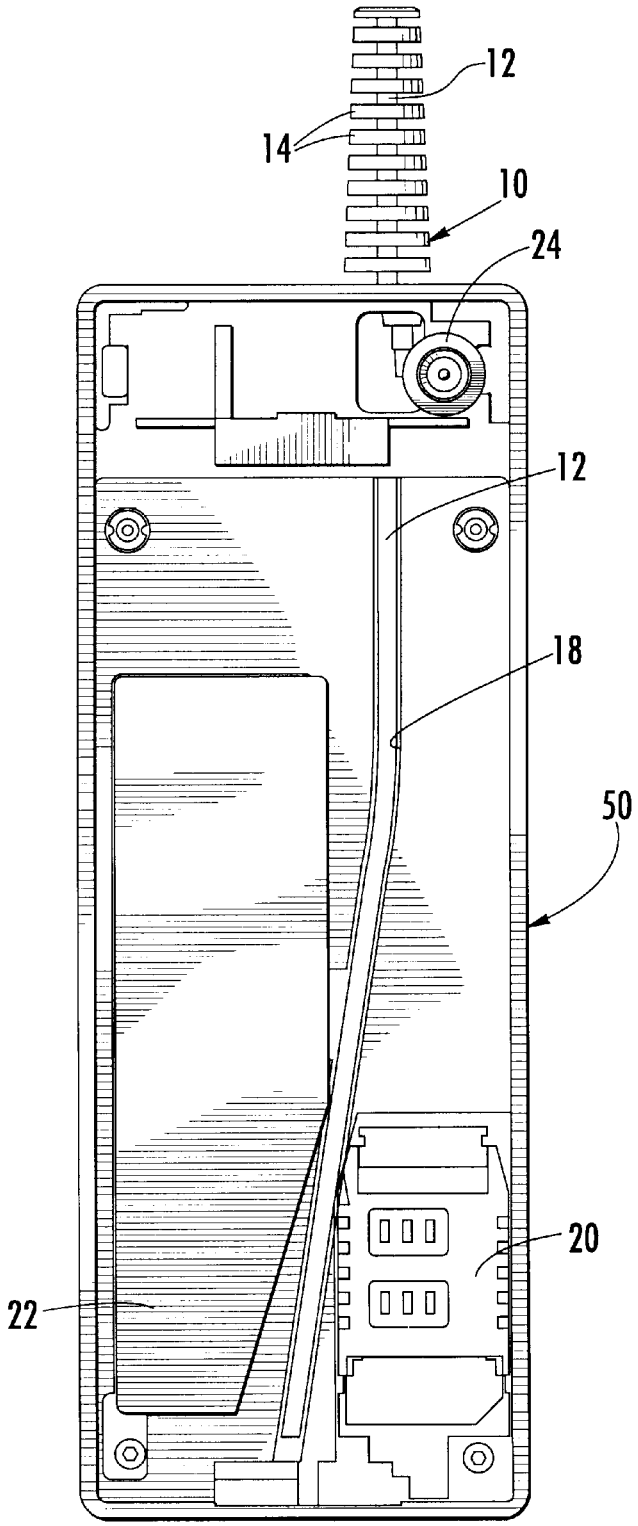
FIG. 4 is a front view of the composite molded heat exchanger and cellular telephone shown in FIG. 3.

Referring to FIGS. 1–4, the net-shape composite molded heat exchanger 10 of the present invention is shown. FIG. 1 shows the overmolded heat exchanger of the present invention and FIG. 2 shows a general cross-sectional view through the heat exchanger shown in FIG. 1. In FIG. 3, a perspective view of the molded heat exchanger 10 of the present invention is shown installed in a cellular telephone 50 while FIG. 4 illustrates a front view of the cellular telephone 50 and heat exchanger 10 shown in FIG. 3. Referring first to FIGS. 1 and 2, the molded heat exchanger 10 includes a heat pipe section 12 with a number of molded fin members 14 extending outwardly from the heat pipe 12. The molded heat exchanger 10 is composite molded by first providing a heat pipe structure 12 which is placed into an injection mold. The heat pipe 12 itself is preferably of any known construction in the prior art, such as a metallic heat conductive tubular member charged with phase change media such as water or ammonia. The fins are then molded around the heat pipe 12 by injection molding, into a unitary structure from thermally conductive material, such as a thermally conductive polymer composition. The thermally conductive polymer composition includes a base polymer of, for example, a liquid crystal polymer that is loaded with a conductive filler material, such as copper flakes or carbon fiber. Other base materials and conductive fillers may be used and still be within the scope of the present invention. Also, the heat exchanger 10 of the present invention is net-shape molded which means that after molding it is ready for use and does not require additional machining or tooling to achieve the desired configuration of the part.

FIG. 2 shows a general cross-section through the heat exchanger of the present invention showing the end of the heat pipe 12 encased by the thermally conductive molded fin members 14. As can be seen, a thin layer of polymer material forms a web 16 between the overmolded fins 14. This web material 16 provides structural support to the fins 14 by holding them in place and maintaining their spacing while supporting the entire array of fins 14 on the end of the heat pipe 12. In addition, the web material 16 and the fins 14 are maintained in tight contact with the surface of the heat pipe 12 thus ensuring thermal communication. The heat exchanger 10 of the present invention therefore provides for heat to be conducted through the heat pipe 12 to the overmolded web 16 and uniformly conducted and dissipated through the fins 14. During use of a cellular telephone, for example, ambient air flows around fins 14 to facilitate heat dissipation.

As described above, the ability to injection mold the thermally conductive device rather than machine it has many advantages. As can be seen in FIGS. 1 and 2, an intricate fin 14 and web 16 arrangement, that has optimal heat transfer geometry and properties, can be easily formed as desired. The figures illustrate one of many embodiments of the invention where a thermally conductive composition is net-shape molded into a thermally conductive heat exchanger construction.

In the preferred embodiment, as shown in FIGS. 3 and 4, the heat exchanger 10 includes a heat pipe 12 with a circular array of plate-like fins 14 overmolded on one end. The other end of the heat pipe 10 is designed to be inserted into the body of a cellular telephone 50. The inserted end of the heat pipe passes through a channel 18 in the cellular telephone 50 and makes contact with heat generating elements 20, 22 therein. The heat generating elements 20, 22 are that are typically contained within a cellular telephone 50 such as a central processor and a transmitter generate a great deal of heat during operation. Due to the compact geometries encountered, it is difficult to find pathways over which heat can be dissipated. The heat pipe 12 arrangement of the present invention being in direct contact with the heat generating components 20, 22 provide a direct pathway for conducting the heat generated to the exterior of the case for effective dissipation in the overmolded web 16 and fin 14 configuration.

As shown in FIGS. 3 and 4, the installation of the heat exchanger 10 of the present invention also serves as an antenna for the cellular telephone. The outer shell of the heat pipe 12 is metallic and provides an ideal surface for transmitting and receiving radio frequency waves. As the heat pipe passes through the body of the cellular telephone, it is contacted by a metallic antenna contact 24. This allows the radio frequency waves being transmitted and received by the cellular telephone 50 to be conducted via the antenna contact 24 into the heat pipe 12 and successfully broadcast. To further enhance this characteristic of the heat sink 10 of present invention to serve as an effective antenna, the thermally conductive filler material that is loaded into the thermally conductive polymer composition used to mold the web 16 and fins 14 is metallic. In the preferred embodiment this filler is copper, however the use of other metallic fillers such as aluminum or magnesium is anticipated as being within the scope of the present invention. The metallic fillers thereby allow the thermally conductive polymer to effectively conduct radio frequency waves through the polymer composition into the heat pipe 12 further enhancing the present invention's utility as an antenna.

In accordance with the present invention, a net-shape molded heat exchanger is disclosed that is easy and inexpensive to manufacture and provides thermal transfer that is superior to prior art metal machined heat exchangers by optimization of the geometry of the device.

It would be appreciated by those skilled in the art that various changes and modifications can be made to the illustrated embodiments without departing from the spirit of the present invention. All such modifications and changes are intended to be covered by the appended claims.

What is claimed is:

1. A net-shape composite molded heat exchanger, comprising:

a thermally conductive heat pipe, having a first end and a second end; and a thermally conductive polymer main body and a plurality of net shape molded thermally conductive polymer fins integrally molded onto said heat pipe covering a portion of said first end of said heat pipe.

2. The heat exchanger of claim 1, wherein said thermally conductive polymer further comprises a polymer base matrix and a thermally conductive filler material therein.

3. The heat exchanger of claim 1, wherein said heat pipe is metallic and capable of transmission and reception of radio frequency waves.

4. A method of net-shape molding a composite heat exchanger, comprising the steps of:

providing a heat pipe having a first end and a second end opposite said first end;

overmolding a main body and a plurality of fins connected to said main body over a portion of said first end of said heat pipe from a thermally conductive composition comprising a polymer base matrix and a thermally conductive filler therein.

5. A cellular phone construction, comprising:

a cellular phone body;

a heat generating component disposed in said cellular phone body;

a metallic heat pipe, loaded with a phase change media, having a first end and a second end opposite said first end, capable of transmitting and receiving radio frequency waves;

a plurality of thermally conductive fins overmolded on said first end of said heat pipe;

said second end of said metallic heat pipe being in thermal communication with said heat generating component.

6. The heat exchanger of claim 5, wherein said thermally conductive fins are net shape molded from a thermally conductive polymer composition.

7. The heat exchanger of claim 6, wherein said thermally conductive polymer further comprises a polymer base matrix and a thermally conductive filler material therein.

* * * * *